US007118005B2

(12) United States Patent
Shimazaki

(10) Patent No.: US 7,118,005 B2
(45) **Date of Patent: *Oct. 10, 2006**

(54) INDIVIDUAL BOTTLE COOLERS

(76) Inventor: J John Shimazaki, 47799 MacGill Ct., Sterling, VA (US) 20165

( * ) Notice: Subject to any disclaimer, the term of this patent is extended or adjusted under 35 U.S.C. 154(b) by 0 days.

This patent is subject to a terminal disclaimer.

(21) Appl. No.: 10/298,613

(22) Filed: Nov. 19, 2002

(65) Prior Publication Data

US 2003/0146227 A1 Aug. 7, 2003

Related U.S. Application Data

(63) Continuation-in-part of application No. 10/066,656, filed on Feb. 6, 2002, now Pat. No. 6,588,621.

(51) Int. Cl.

| | |
|---|---|
| ***A47J 41/00*** | (2006.01) |
| ***B65D 81/38*** | (2006.01) |
| ***F25D 3/08*** | (2006.01) |
| *B65D 83/72* | (2006.01) |

(52) U.S. Cl. ..... 220/737; 62/457.3; 62/457.4; 220/23.87; 220/739; 220/592.17

(58) Field of Classification Search ..... 220/592.17, 220/740, 4.21, 23.87, 739, 737; 62/457.3, 62/457.4

See application file for complete search history.

(56) References Cited

U.S. PATENT DOCUMENTS

| | | | | |
|---|---|---|---|---|
| 1,354,712 | A * | 10/1920 | Altenberg | 215/12.1 |
| 4,823,974 | A | 4/1989 | Crosser | |
| 4,870,837 | A | 10/1989 | Weins | |
| 5,862,937 | A | 1/1999 | Carrizales et al. | |
| 6,398,061 | B1 * | 6/2002 | Duff et al. | 220/592.16 |
| 6,516,967 | B1 | 2/2003 | Duff et al. | |
| 6,588,621 | B1 * | 7/2003 | Shimazaki | 220/592.17 |

FOREIGN PATENT DOCUMENTS

| | | |
|---|---|---|
| JP | 7-14976 | 3/1995 |

* cited by examiner

*Primary Examiner*—Nathan J. Newhouse
*Assistant Examiner*—Niki M. Eloshway
(74) *Attorney, Agent, or Firm*—J. John Shimazaki

(57) ABSTRACT

The present invention relates to a method of promoting bottled beverage products by promoting an individual bottle cooler made specifically for that bottled beverage product. The bottle cooler preferably comprises a container for containing ice and/or water that is adapted to have the beverage bottle positioned substantially therein, wherein regular ice and/or water from standard ice dispensers can be stored and sealed within the space between the bottle and container, to help keep the beverage inside cool. The space is preferably substantially sealed by a cap which is adapted with an opening and a sealing member that extends over the neck of the bottle, wherein the bottle can be held in substantial compression between the sealing member and one or more supporting surfaces extending substantially underneath the bottle.

20 Claims, 6 Drawing Sheets

INDIVIDUAL BOTTLE COOLERS

RELATED APPLICATIONS

This application is a continuation-in-part of, and claims priority from U.S. patent application Ser. No. 10/066,656, filed on Feb. 6, 2002, now U.S. Pat. No. 6,588,621 which is incorporated herein by reference.

FIELD OF THE INVENTION

The present invention relates to the field of coolers, and in particular, to individual bottle coolers.

BACKGROUND OF THE INVENTION

Commercial beverages, such as soda, juice, fruit drinks, sports drinks, water, etc., are often sold in bottles made of PET. A typical beverage aisle of a grocery store or refrigerator of a convenience store is full of a wide variety of bottled beverage products in all shapes and sizes. While most aluminum cans are sold in 12 ounce sizes, most PET bottles are sold in larger sizes, ranging from ½ liter to 3 liters, including the popular 20 ounce, 64 ounce and 2 liter PET sizes.

The development of larger PET bottle sizes has meant that the consumer receives more beverage per container. But the downside is that with more beverage, additional cooling is needed to keep the beverage in the bottle cool, i.e., for a longer period of time. For example, when a single serving 20 ounce bottle is purchased, more beverage means that it will take more time to finish the beverage, or that beverage will be left over. In either case, when the weather is warm, such as on a hot sunny day, or inside a hot car, exposure to high temperatures can result in the beverage becoming warm quickly without any means of keeping the beverage cold. Two liter and other larger sizes are susceptible to the same circumstances, such as during an outdoor picnic, or other function, where no refrigerator is available to keep the beverage cold.

In the past, resort has been made to using ice chests, but there are disadvantages to doing so. For example, because PET bottles are often larger than cans, larger ice chests are typically needed, in which case they can be quite cumbersome to use. Moreover, it is particularly burdensome to use an ice chest if only a single serving beverage is desired. Also, when two liter or other larger bottles are involved, it is often impractical to keep them in ice chests while the beverage is being served.

Many individuals choose to pour beverages into other containers, such as cups, mugs, sports bottles, thermal bottles, etc., with ice directly in the beverage to keep it cold. The disadvantage of this, however, is that as ice melts, the beverage becomes diluted. Also, because ice is often made with unfiltered tap water, impurities can be introduced into the beverage, which can, for instance, defeat the purpose of buying bottled water. Carbonation can also dissipate quickly as beverage is poured into another container. The containers also have to be washed after each use.

Archaic attempts have also been made, such as in the days when refrigerators were not available. For example, in U.S. Pat. Nos. 81,814 and 303,815, wine bottle coolers with diaphragms to hold bottles in place are shown, but these designs are neither compact, nor suitable for bottles with twist off lids, since the bottles were free to rotate. In later years, as shown in U.S. Pat. Nos. 3,998,072, 4,281,520, 5,555,746 and 5,904,267, containers with various compartments, sleeves and packs filled with refrigerants that could be frozen were also developed, but these were required to be frozen and refrozen after each use, and therefore, were not widely used. Various types of insulated containers were also developed, which helped to maintain the temperature of the beverage, with no ability to make the beverage any colder.

What is needed, therefore, is a new and improved method and apparatus for keeping beverages cold, which overcomes the disadvantages of previous cooling methods and apparatuses.

SUMMARY OF THE INVENTION

The present invention relates to a method and apparatus for cooling beverage bottles and/or keeping beverage bottles cold. The present invention generally comprises a cooling device for containing ice and/or water adapted to have the beverage bottle positioned therein, wherein regular ice, such as from a conventional dispenser, and/or water, can be stored and sealed within the space between the container and bottle, to keep the beverage cool.

The container is preferably specifically sized and shaped so that a particular beverage bottle can be held securely inside, wherein a cap is provided to create a water-tight seal around the shoulder of the bottle, and one or more supports are provided around and/or under the bottle to provide support thereto. In this respect, the bottle is preferable held inside the container, with the neck of the bottle extending through the cap, with the seal substantially preventing ice and/or water from leaking out. This way, ice and/or water can be maintained in direct contact with the bottle, and the beverage can be maintained at a reduced temperature, without diluting or introducing contaminants into the beverage. The beverage can also easily be poured, served and consumed without having to take the bottle out of the ice.

In the preferred embodiment, the container is preferably adapted to securely hold a particular beverage bottle, such as a PET bottle having a certain size and shape. In this embodiment, the container is preferably comprised of two sections that can be connected and sealed together, i.e., an upper cap member and a lower container member. The container member is preferable an open-top container, similar to a mug or jug, which can have a handle or grips thereon, adapted so the bottle can be inserted at least partially into the container and supported thereby. The cap member is preferably a cap-like member that can be secured and sealed onto the container member. Unlike previous caps, however, this member preferable has a central opening, with a sealing member positioned substantially along the inside surface thereof around the opening. This way, when the beverage bottle is placed inside the container, the neck can be extended through the opening, wherein the cap member can be tightened onto the container, such that the sealing member is pressed and sealed against the exterior of the bottle. i.e., around the shoulder of the bottle, thereby sealing the space between the bottle and container.

The container member preferably has one or more individual supports on the inside thereof to provide vertical and lateral support to the bottle. This way, when the cap member is tightened onto the container member, the bottle can be held in substantial compression between the sealing member and supports. In one embodiment, three or more supports are extended inside the container member to provide a support system for self-centering the bottle and maintaining the bottle in a substantially fixed position, such as above the floor of the container member. Each support in such case is preferable adapted to engage a lower portion of the bottle such that the bottle can be held in a substantially fixed position. In another embodiment, a central support can be provided which extends upward from the floor of the container to engage the center indentation on the bottle. In either case, the support system preferable keeps the bottle in a substantially fixed position within the container. A goal of the present invention is to substantially minimize the surface area contact between the container and bottle, on one hand, and substantially maximize the surface area contact between the ice and/or water and bottle, on the other hand.

Another preferred aspect of the present invention is that at least one of the supports is preferably adapted to mate with a portion of the bottle to substantially prevent the bottle from rotating, which enables the lid on the beverage bottle to be easily twisted open and closed without the bottle rotating inside. Preventing rotation of the bottle can be accomplished by adapting at least one of the supports so that it fits into a groove and/or indentation on the bottom of the bottle. Where PET bottles having multiple grooves and/or indentations or other formations are used, at least one support is preferably adapted to fit into one of the grooves and/or indentations, wherein with the bottle in position inside the container, the bottle can be Prevented from rotating.

Where the central support is used, the upper surface of the central support can be configured to conform or otherwise mate with or engage the bottom of the bottle, wherein the mating of the two surfaces, with the bottle in compression, can also help prevent the bottle from rotating. This can be done, for example, by adapting the upper surface of the central support to fit into one of the indentations located on the bottom of the bottle. Alternatively, the central support can be removable or made using a coil spring to enable bottles of different shapes and sizes to be used.

The cap and container members are preferably connected together with threads, such as with an overlapping interference fit, or a gasket, so that they can easily be sealed together. The cap and container members are preferably adapted so that the connection between them can be sealed at the same time that the cap is sealed against the bottle. That is, the container is preferable adapted so that the connection between the cap and container, and between the car and bottle, occur at the same time, i.e., with the cap in the same position relative to the container.

The present invention contemplates that in one embodiment a lower portion of the container can be made relatively narrow, so that it can fit into conventional cup holders, such as found in cars. This portion creates additional space in which ice and/or water can be stored, such as underneath the bottle, in direct contact with the bottle. In this embodiment, it is Preferable that the supports be extended from the wall of the container, such as on or just above the narrowed portion, so that the bottle can be elevated above the floor of the container. The area of the container just above the narrowed portion can be extended radially outward, such as along a curved and/or angled surface, to enable ice to be displaced up as the bottle is shoved into the container.

The sealing member is preferably secured to the inside of the cap and extended around the opening so that it can be pressed against the bottle, and is preferably made of a resilient material that can apply pressure against the bottle to create a waterproof seal. Although the sealing member can be secured to the cap by any conventional means, such as adhesives, fusing, bonding. etc., for ease of assembly, the sealing member can have a flange that can be extended through the opening, wherein the sealing member can be mechanically snapped into the cap from underneath.

Another aspect of the present invention is that the cooling device can be specifically made to accommodate a certain type of beverage container, while not accommodating other beverage containers, such as those having different sizes and shapes. PET bottles often come in a variety of different sizes and shapes, even for the same amount of beverage. For example, Coke® currently uses 20 ounce bottles that have a tapered neck, whereas Pepsi® uses 20 ounce bottles that are bubble-like with swirls. A unique aspect of the present invention is that the cooling device can be made so that it allows one type of bottle to be used, i.e., a Pepsi® 20 ounce bottle, whereas other bottles, such as one made by a competitor, i.e., a Coke® 20 ounce bottle, would either not fit, or allow water to leak.

DETAILED DESCRIPTION OF THE INVENTION

Figure 1:
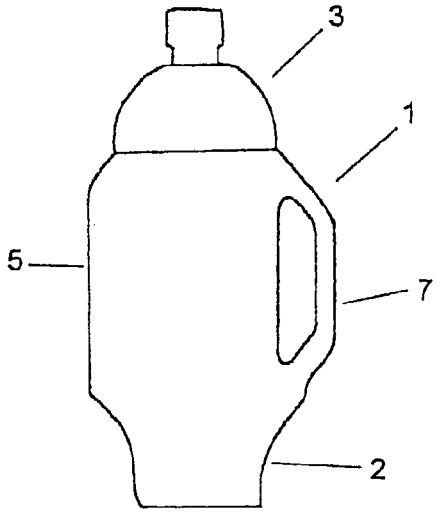
FIG. 1 is a side view of an embodiment of the present invention.
Figure 2:
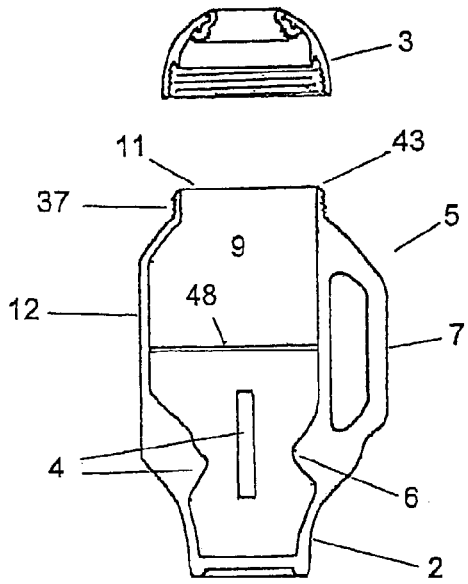
FIG. 2 is a section view of the embodiment of FIG. 1.
Figure 3:
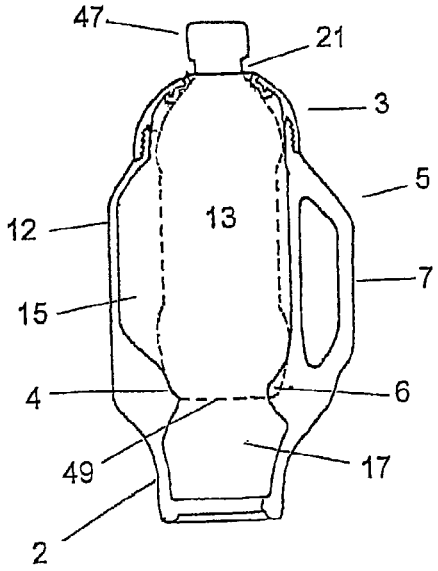
FIG. 3 is another section view of the embodiment of FIG. 1 showing a typical PET bottle in dashed lines.

FIGS. 1–3 show a bottle cooler 1 having a container 5 and cap 3 designed to be connected and sealed together. As seen in FIGS. 2–3, container 5 is preferably an open-top container having a handle 7 and an internal space 9 formed by a wall 12, wherein an opening on the top 11 preferably enables a bottle 13, such as a commercial beverage bottle, to be inserted therein. Container 5 preferably has extended on the inside thereof a plurality of supports 4, 6, such as from wall 12, which are adapted to provide lateral and vertical support to bottle 13. This way, bottle 13 can be inserted into container 5 and held by supports 4, 6, wherein space 15 can be formed between bottle 13 and container 5, as shown in FIG. 3, in which ice and/or water can be stored and sealed.

Wall 12 can be cylindrical or any shape that allows space 15 to be of sufficient size. Preferably, the distance between wall 12 and bottle 13 allows conventional size ice particles, such as cubed ice, diced ice, chopped ice, crushed ice, etc., from conventional ice dispensers, to be easily distributed and stored therein. Many ice dispensers form particles that are less than about one-half inch thick, i.e., the minimum dimension, and therefore, it is contemplated that the distance between bottle 13 and wall 12, as shown in FIG. 3, can be between about three-quarter inch and one inch, although virtually any dimension that serves the intended purpose can be used. For example, where it is desirable that larger ice cubes be used, the distance between bottle 13 and wall 12 can be greater, i.e., one and one-half inch or more. In this respect, the minimum distance between bottle 13 and wall 12 is preferably about ¼ inch to ½ inch greater than the minimum dimension of the ice particles that are intended to be used in container 5. While it is desirable to provide sufficient space 15 for the ice, it is also desirable for container 5 to be compact and easy to manufacture, and therefore, the present invention contemplates that these factors should be taken into consideration when forming the container.

Figure 9:
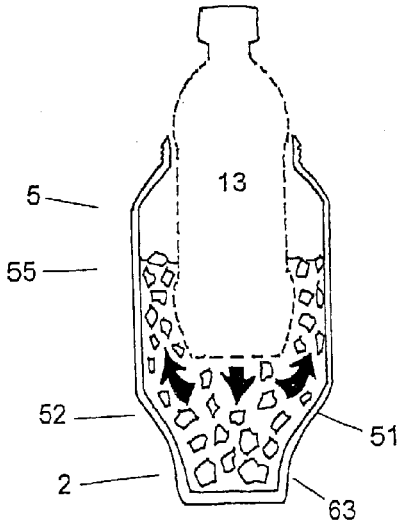
FIG. 9 shows ice being displaced by the bottle inside the container.
Figure 10:
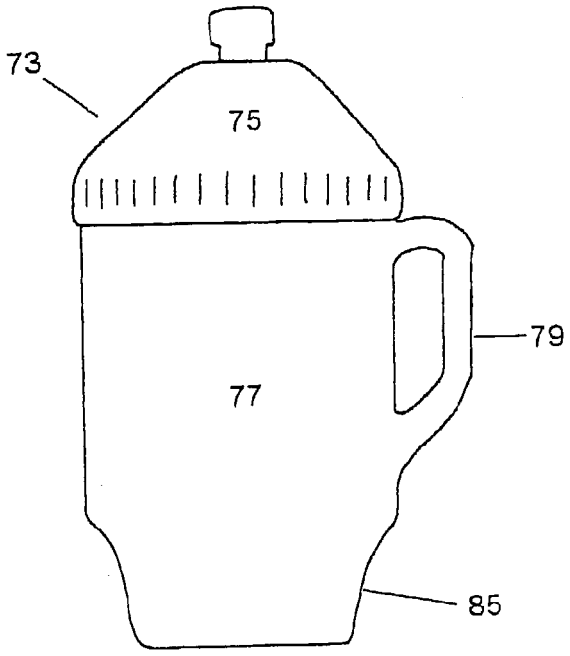
FIG. 10 shows another embodiment of the present invention.

Container 5 preferably has a lower section 2 that is narrowed to fit into conventional cup-holders. Lower section 2 preferably forms cavity 17 below bottle 13 and allows additional ice to be stored in container 5 substantially surrounding a lower end 49 of bottle 13, as shown in FIG. 3. As shown in FIG. 9, the section 52 immediately above lower section 2 is preferably extended radially outward, such as in a curved, sloped and/or angled manner, wherein this configuration 51 can cause ice to climb up the sidewall of bottle 13 when bottle 13 is shoved down into the ice, as shown by the arrows. The location of sloped surface 51 in relation to the supported position of bottle 13 preferably ensures that ice can easily be displaced around the lower portion of bottle 13 without getting trapped inside lower section 2. That is, the minimum distance between the lower surface of bottle 13 and sloped surface 51 is preferably about the same as the minimum distance between bottle 13 and wall 12, as described above, such that none of the ice particles are trapped in lower section 2 as bottle 13 is inserted into the ice. In this embodiment, top 11 of container 5 can be narrowed to receive a relatively narrow cap 3, which can make cap 3 and container 5 easier to grasp, and prevent ice from escaping while inserting bottle 13 into the ice.

Figure 5:
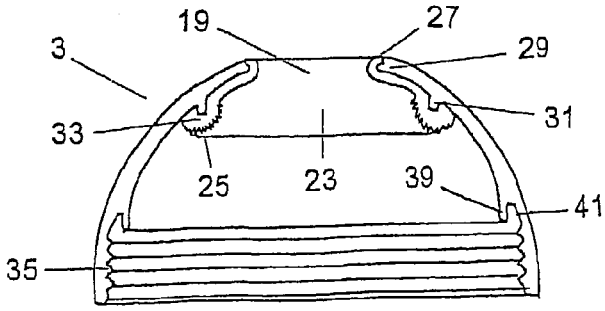
FIG. 5 is a section view of the cap.

Cap 3 preferably has a central opening 19, as shown in FIG. 5, through which neck 21 of bottle 13 can extend. Cap 3 also preferably has a resilient sealing member 23 extended on the inside and substantially around opening 19. When cap 3 is tightened onto container 5, with neck 21 extended through opening 19, sealing member 23 preferably engages and presses against the shoulder of bottle 13, to substantially seal space 15 with bottle 13 inside container 5, as shown in FIG. 3.

Figure 11:
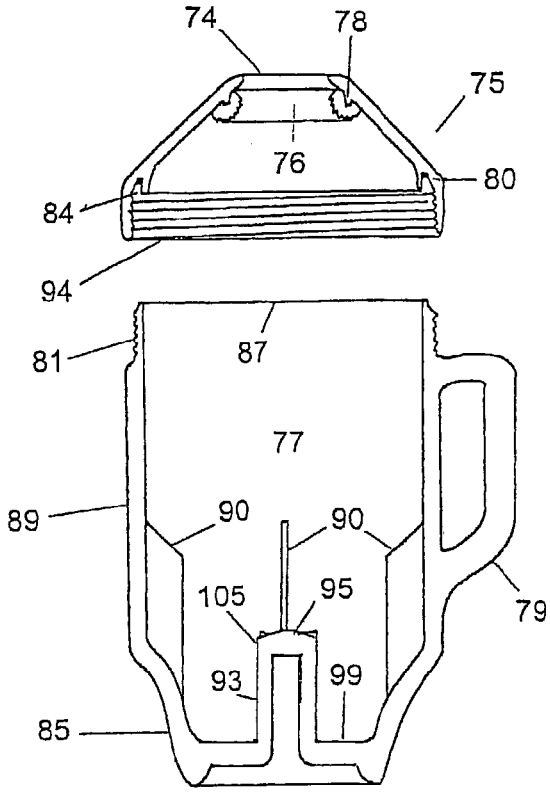
FIG. 11 is a section view showing a fixed support.

Sealing member 23 preferably has an engaging surface 25, which can have virtually any cross-sectional configuration that performs in the intended manner. For example, it can have a semi-circular or semi-oval cross-section, as shown in FIG. 11, and/or multiple blade or ribbed cross-section, as shown in FIG. 5, which can help promote water-tightness, even against unevenly shaped bottles. It can also be shaped like sealing member 242 shown in FIGS. 25*a* and 25*b*. Sealing member 23 can also be connected to cap 3 in any manner that provides a tight seal, including an interference fit, interlocking sections, adhesives, bonding, fusing, etc. Preferably, sealing member 23 is inserted into cap 3 with an interference fit (by making sealing member 23 slightly larger in diameter than the area to which it is to be connected), chemically bonded to cap 3 using a two shot or over-mold method, as is known in the art, or formed with an extended flange 27 that fits above an upper edge 29 of cap 3 so that it can be snapped into opening 19 and held therein. One or more raised projections 31 is preferably provided extending on the underside of cap 3 that mates with one or more grooves 33 on sealing member 23. Projection 31, in this respect, can provide a pinching effect to sealing member 23, i.e., to help provide an effective seal against bottle 13, and can help support sealing member 23 on cap 3.

Sealing member 23 is preferably made of resilient material, such as rubber, silicon, polypropylene, polyethylene, or a combination thereof, or other like material, etc. The present invention contemplates that sealing member 23 can be resilient, but firm and/or thick enough, so that a degree of tolerance can be provided at the connection between sealing member 23 and bottle 13. That is, even if bottle 13 is not made to exact dimensions, it is nevertheless contemplated that enough sealing pressure can be applied via sealing member 23, i.e., by virtue of its resiliency and/or thickness, against bottle 13, to prevent leaking. It has been found that in the preferred embodiment sealing member 242 shown in FIGS. 25*a*, 25*b* can be made using a durometer of between 25A and 50A. Although sealing member 23 is shown, it can be seen that a variety of different types of sealing members, including sealing members 76 and 242, are possible.

Cap 3 preferably has threads 35 along an internal diameter thereof for engaging threads 37 along an external diameter of container 5. The threads can be continuous or broken. An interference fit, valve seal or other linerless connection can be created between an upper rim or landing 43 of container 5 and a groove or surface 41 formed by an extension 39 extending downward above threads 35, wherein the connection between cap 3 and container 5 can be tightened and substantially sealed thereby. Groove 41 can be adapted to enable a seal to be made even if upper rim 43 is not fitted all the way into groove 41, to provide some tolerance as described above. Alternatively, a sealing gasket can be provided within groove 41, like sealing gasket 244 shown in FIGS. 25*a* and 25*b*, wherein a substantially horizontally oriented landing can be extended inward on upper rim 43 which can be sealed against the sealing gasket. Likewise, a pair of clamps, buckles, or similar device, can be provided to seal cap 3 onto container 5.

Various supports, such as 4, 6, for supporting bottle 13 in relation to container 5 are contemplated. Supports 4, 6 preferably keep bottle 13 at a relatively fixed position inside container 5, so that when cap 3 and container 5 are tightened together, bottle 13 can be held in substantial compression between sealing member 23 and supports 4, 6, with sealing member 23 pressed tightly against bottle 13 to form a substantial water-tight seal. In this respect, cap 3 and container 5 are preferably adapted to hold a particular bottle 13 having a predetermined size and shape, which requires the shape, size and location of supports 4, 6 to be adapted in conjunction with the shape, size and location of sealing member 23, and the distance between them predetermined, for a particular bottle 13 in a substantially fixed position inside container 5. With bottle 13 held in this manner, the threaded connection between cap 3 and container 5 can preferably be sealed at the same time that the engagement between sealing member 23 and bottle 13 is sealed. That is, the connection and engagement are preferably sealed with cap 3 in the same position relative to container 5.

In this embodiment, at least three supports 4, 6 are preferably provided to create a triangular support system to hold the lower end of bottle 13 in position inside container 5, wherein each support is preferably adapted to engage a particular surface of bottle 13, while allowing a substantial portion of the ice particles to be in direct contact with bottle 13. For example, in the embodiment of FIGS. 1–3, four supports are shown (but only for demonstration purposes)—three supports 4 for engaging the lower exterior surface 49 of bottle 13, and one slightly raised support 6 for engaging a groove 45 located on the underside of bottle 13.

Figure 4:
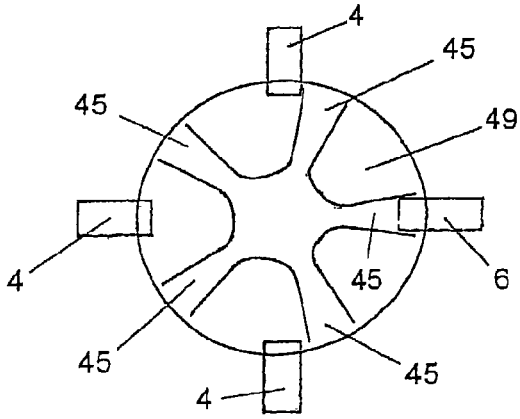
FIG. 4 shows the bottom of a typical PET bottle with five grooves and/or indentations.

As seen in FIG. 4, the bottom of a typical PET bottle 13 has multiple grooves 45, i.e., many have five grooves, to provide rigidity and support thereto. By forming at least one of the supports 6 to fit inside one of the grooves 45, the bottle 13 can be substantially prevented from rotating inside container 5. That is, the compression of bottle 13 between sealing member 23 and supports 4, 6, enables the fit between the raised support 6 and one of the grooves 45 to be maintained, so that as long as cap 3 remains sealed on container 5, bottle 13 will not rotate. This enables the lid 47 of bottle 13 to be easily twisted open and closed without bottle 13 also rotating inside container 5. The embodiment shown has one raised support 6, but more of the supports 4, including all, can be adapted to fit into grooves 45, if desired.

In use, standard ice particles, such as chopped, cubed, crushed, diced, etc., are preferably placed inside internal space 9 of container 5 before bottle 13 is inserted. An indicator line 48, as shown in FIG. 2, or other indicator, is preferably provided on the inside surface of container 5 to indicate how much ice should be placed therein. The location of this line is based on the amount of ice particles that should be placed in container 5 to enable the space 15, including cavity 17, to be substantially filled when bottle 13 is inserted and properly positioned inside container 5. This helps the user know how much ice to use to maximize contact between the ice particles and bottle 13, while avoiding too much ice, which could prevent bottle 13 from being inserted into container 5, and cap 3 from being tightened.

Next, bottle 13 is pushed down into the ice, which causes some of the ice to be displaced, as shown in FIG. 9, and climb up the sidewalls of bottle 13. The sloped surface 51, in this respect, above the lower section 2, preferably helps to cause ice to be displaced and distributed upward as bottle 13 is being pushed downward. The distance between surface 51 and bottle 13 preferably enables bottle 13 to be inserted without ice being trapped inside lower section 2. Water can be added to container 5 to make it easier for the ice particles to be displaced and distributed around bottle 13 if desired, i.e., such as when relatively large ice cubes are used.

Next, bottle 13 is preferably pushed down until the lower exterior surface 49 of bottle 13 is properly centered, seated and rests on supports 4, 6. Alternatively, bottle 13 can be pushed down part of the way, and cap 3 can be placed over bottle 13 with neck 21 extended through opening 19, and then tightened onto container 5, which due to the self-centering effect of supports 4, 6 automatically causes bottle 13 to be properly seated thereon. Tightening cap 3 preferably causes sealing member 23 to be pressed and sealed against the shoulder of bottle 13, while at the same time, the connection between cap 3 and container 5 can also be sealed. Ice and/or water within space 15, including cavity 17, can then be stored and sealed, substantially surrounding bottle 13, to keep the beverage cool. This prevents water, such as from melting ice, from leaking out, and enables the beverage to be poured and consumed directly from bottle 13, without having to remove bottle 13 from the ice.

Figure 6:
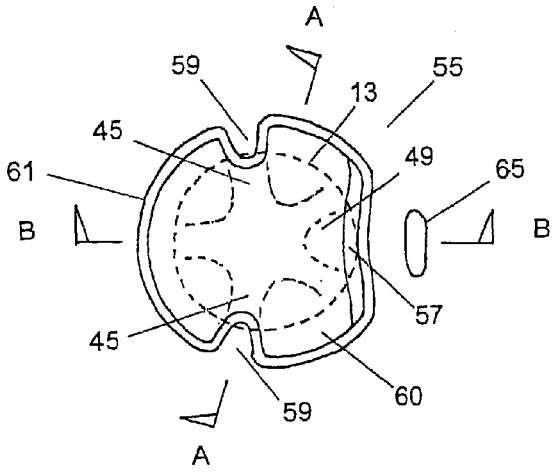
FIG. 6 is a horizontal section view of an alternate embodiment.
Figure 7:
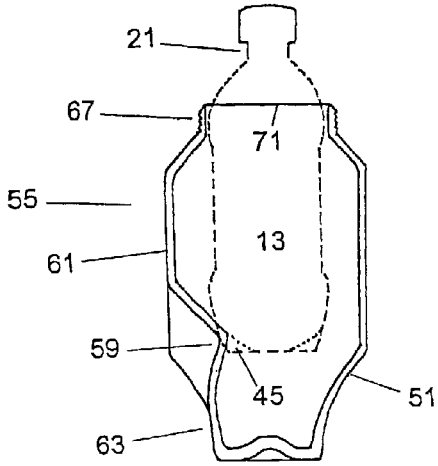
FIG. 7 shows section A—A of the embodiment of FIG. 6.
Figure 8:
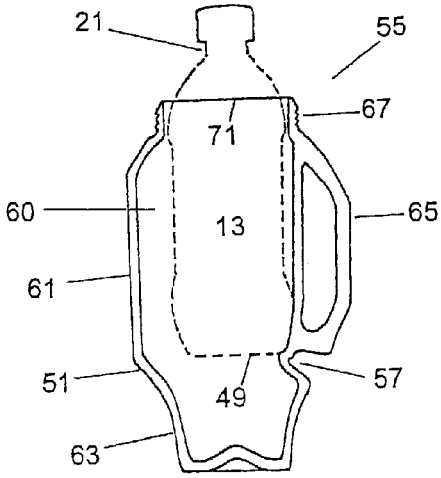
FIG. 8 shows section B—B of the embodiment of FIG. 6.

FIGS. 6–8 show a preferred embodiment for a single serving bottle, such as a 20 ounce bottle, that can be manufactured at a relatively low cost. Container 55 is preferably molded, such as by a blow-mold process, from a single piece of moldable plastic material. Container 55 is preferably generally sized and shaped like container 5, with a narrowed lower section 63, handle 65, thread 67, wall 61, space 60 (between bottle 13 and wall 61), upper opening 71, etc., wherein a similar cap 3 can be used. Supports 57, 59 on container 55 are preferably adapted to provide vertical and lateral support to bottle 13. However, in this embodiment, they are preferably indented directly into wall 61 so that container 55 can be blow-molded. Container 55 is preferably formed having a substantially constant wall thickness, i.e., a thickness that can be formed by blow-molding, wherein the thickness at supports 57, 59 is preferably substantially predetermined to enable bottle 13 to be held in substantial compression between sealing member 23 and supports 57, 59. In this respect, the parasin formed during blow-molding can be programmed to predetermine the thickness of supports 57, 59, which can be a factor in ensuring that bottle 13 can be properly held and sealed inside container 5.

In this embodiment, three supports, including one support 57 for engaging an exterior portion 49 of bottle 13, and two raised supports 59 capable of being fitted into two of the five grooves 45 on bottle 13 to substantially prevent rotation of bottle 13, are preferably provided. Each of the three supports 57, 59 preferably has a sloped upper surface to help self-center bottle 13 inside container 55, i.e., as bottle 13 is being pushed down into the ice. The two raised supports 59 on container 55, as shown in FIG. 6, are preferably positioned on opposing sides, such that they can fit into opposing grooves 45 on bottle 13, and such that they can be formed using blow-mold halves with the appropriate draft on each surface. Support 57, on the other hand, is preferably formed along a parting line, i.e., on a sidewall under handle 65, and, in this respect, is preferably positioned equidistant from the two raised supports 59, such that the three supports 57, 59 form a triangulated support system, i.e., symmetrical about a vertical center plane B—B, which also represents the parting line. In this respect, one wall of each raised support 59, and the entire support 57, are preferably extended at least perpendicular (with an appropriate draft which is not shown) to plane B—B, wherein this configuration allows two blow-mold halves to be properly separated once container 55 has been formed. Supports 57, 59 are also preferably spaced far enough apart from each other to allow the ice particles to be easily displaced without being trapped in lower section 2.

Figure 18:
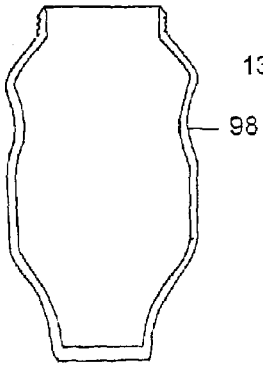
FIG. 18 shows an embodiment with external grip formations.

Like the previous embodiment, container 55 preferably has a section 52 extended radially outward, as shown in FIG. 9, with a sloped surface 51, which allows ice to be easily displaced and distributed. Supports 57, 59 are also preferably designed not to interfere with the displacement of ice from lower section 2. Handle 65 is shown solid, but can be hollow when formed using a blow-mold. To make container 55 easy to mold, i.e., such as to avoid flashing, handle 65 can be replaced by indented grips 98, as shown in FIG. 18, or, the upper portion around opening 71 can be made narrow enough to hold with one hand, so that no handle or grips are needed. In these versions, e.g., where no handle is provided, a shrink-wrap plastic label for graphic displays on the container can be provided.

FIGS. 10–13 show an additional embodiment 73 having a cap 75 and container 77 capable of being secured and sealed together with bottle 83 inside. Like the previous embodiments, cap 75 is preferably adapted with an opening 74, through which neck 86 of bottle 83 can be extended. Inside container 77, a space 91 is preferably formed between wall 89 and bottle 83 when bottle 83 is inserted into container 77, wherein ice and/or water can be stored therein. While in one version, container 77 is specifically adapted and sized to fit a particular bottle 83, other versions contemplate that various bottles of similar but different sizes and shapes can be fitted inside container 77, i.e., by means of different central supports 93, as will be discussed. Although this embodiment can be adapted for virtually any size bottle, it is particularly suited to larger bottles, such as 2 liter and 64 ounce PET bottles, where no need for a narrowed lower section to fit into cup-holders exists, although the lower section 85 can be narrowed as shown if desired.

Figure 12:
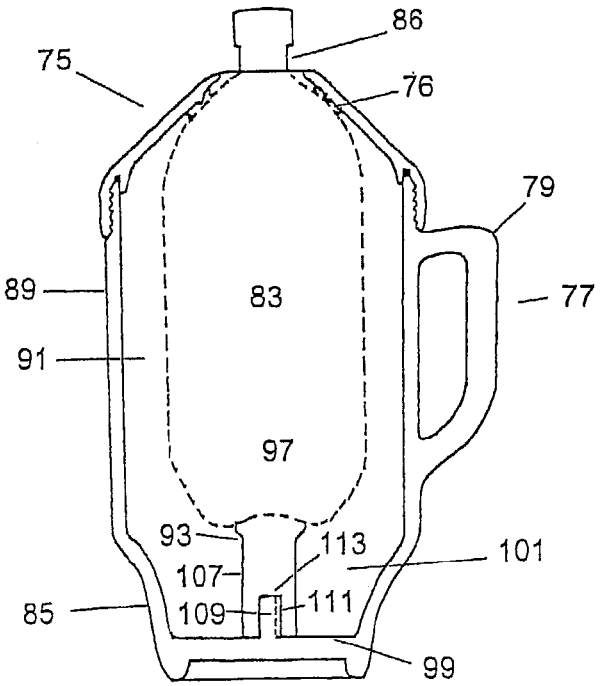
FIG. 12 is a section view showing a removable support.

At least two versions are shown in FIGS. 11-12. Both versions are preferably provided with a support 93 extending upward like a pedestal from the lower floor 99 of container 77, although not necessarily so, wherein support 93 is adapted to provide vertical and lateral support to bottle 83. In this respect, bottle 83 is preferably held in substantial compression between sealing member 76 on cap 75 and central support 93 inside container 77.

Figure 13A:
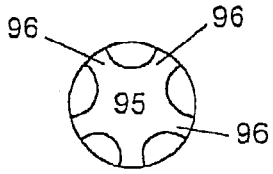
FIGS. 13*a* to 13*c* show views of the removable support.
Figure 13B:
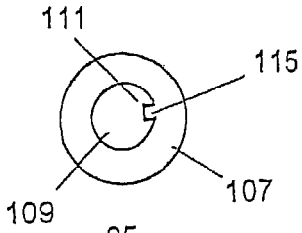
Figure 13C:
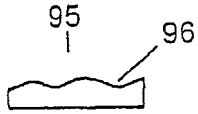

Support 93 preferably elevates bottle 83 above floor 99, wherein an additional cavity 101 can be formed under bottle 83, as shown in FIG. 12, such that additional ice and/or water can be stored therein, although this is not required. Lateral support can be provided by the rigidity of central support 93 and its engagement into an indentation 97 on the bottom surface of bottle 83, as shown in FIG. 12. Most PET bottles have a concave indentation 97 in the bottom center, wherein a pattern with multiple grooves or other formations are provided to give rigidity and support thereto. The present invention contemplates that the upper surface 95 of central support 93, as shown in FIG. 13*a*, can be specifically configured with reciprocal grooves or formations 96, that can mate or mesh with, or otherwise engage, indentation 97, such that when bottle 83 is held in substantial compression between support 93 and sealing member 76, bottle 83 can be held in a relatively fixed position. Engagement of central support 93 with indentation 97 can substantially prevent rotation of bottle 83, i.e., by holding bottle 83 in substantial compression with central support 93 pressed tightly against indentation 97, and reciprocal formations 96 fitting within the grooves on the bottom surface of bottle 83, such as grooves 45 shown in FIG. 4. The upper surface 95 can be extended like a seat, as shown in FIGS. 13*a* and 13*c*, with contours 96.

FIG. 11 shows a fixed central support 105 extending from floor 99, wherein upper surface 95 preferably conforms to the shape of the particular indentation 97. A plurality of self-centering slats 90 or other formations (three or more) can be formed on wall 89 to guide bottle 83 onto support 93. The fixed support 105 can be formed as an extension in floor 99, as shown in FIG. 11, or a solid extension or attachment to floor 99, or in any other manner. For example, support 105 can be configured like support 220 shown in FIGS. 23*b* and 24*a*, as will be discussed.

FIG. 12 shows a removable central support 107, wherein a plurality of supports of varying sizes and shapes can be employed in connection with a single container 77. Each support 107 preferably has an upper surface 95 adapted for a particular bottle, i.e., depending on the size and shape of indentation 97. Each support 107 also preferably extends upward a certain height depending on the height of the intended bottle. This way, a single container 77 can be used to fit a number of similar but differently sized and shaped bottles, simply by attaching and detaching the appropriate supports 107 as needed.

Support 107 can be attached to floor 99 in a variety of ways. In each instance, the attachment is preferably adapted so that support 107 remains in a substantially fixed position and is prevented from rotating relative to floor 99. In one attachment, as shown in FIGS. 12 and 13*b*, a round stem 109 is extended from floor 99, which has a vertical indented slot 111. In such case, support 107 is provided with a reciprocal bore 113, with a slot-engaging extension 115. This way, support 107 can be attached and detached simply by sliding support 107 on and off stem 109. Alternatively, slot 111 can be in bore 113, and the extension 115 on stem 109. The two pieces can also be reversed, i.e., bore 113 can be located on floor 99, and stem 109 can be extended from support 107. Alternatively, stem 109 and bore 113 can be adapted with connecting non-circular shapes, such as square, rectangular, triangular, etc., which can prevent rotation of support 107.

Wall 89 can be made without self-centering slats 90 so that larger diameter bottles can be used. For example, instead of a 2 liter bottle 83 shown in FIG. 12, a wider and shorter 64 ounce PET bottle may be used. In such case, the slats 90 could interfere with the bottle. Even without slats, however, support 107 is preferably adapted so that upper surface 95 provides a self-centering effect to bottle 83, wherein support 107 can support bottle 83 in a relatively fixed position. This is also true of fixed support 105 and other supports, such as 220. Opening 87 on container 77 can also be made large enough, as shown, so that ice can be added to container 77 even after bottle 83 is inserted into container 77. This way, bottle 83 can be located on support 93 first, and then ice can be added, so that the bottle does not have to be shoved down into the ice.

Like the previous embodiments, cap 75 preferably has threads 94 that engage threads 81 on container 77. A sealing gasket 80 can also be provided in interference groove 84, although any water-tight seal, as discussed previously, can be employed. Like sealing member 23, sealing member 76 is preferably made of resilient material, and can be in the shape of an O-ring having a semi-rounded cross section with blades or ridges extending longitudinally thereon, wherein sealing member 76 is capable of being sealed against various surfaces, which is advantageous, for example, where different bottles are used. Sealing member 76 can be secured to cap 75 via one or more projections 78, as well as by interference fit, bonding, an adhesive, or other secure means, as discussed previously.

Figure 14:
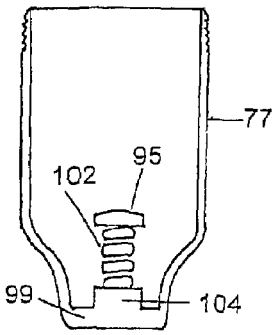
FIG. 14 shows a coil spring embodiment.

In an alternate embodiment, central support 93 can be a coil spring 102, as shown in FIG. 14, to accommodate bottles of different sizes. Spring 102 is preferably secured to floor 99 of container 77 via housing 104 in a manner that prevents rotation thereof, i.e., such as with a non-circular connection. Spring 102 is preferably substantially stiff enough to apply upward pressure to bottle 83 to maintain a water-tight seal against sealing member 76, and to keep bottle 83 in a substantially fixed position, without being too stiff such that it would not compress under the pressure of cap 75 being tightened. The dimensions of spring 102 are preferably large enough, and the tension thereof preferably stiff enough, so that spring 102 will not twist with respect to itself, wherein by engagement of upper surface 95 with indentation 97 and one or more grooves on bottle 83, bottle 83 can be substantially prevented from rotating. In this respect, upper surface 95 can be provided with a secure non-rotational attachment to spring 102 so that the entire pedestal prevents rotation. Spring 102 is preferably made of a rust-proof material such as aluminum or stainless steel.

Figure 15:
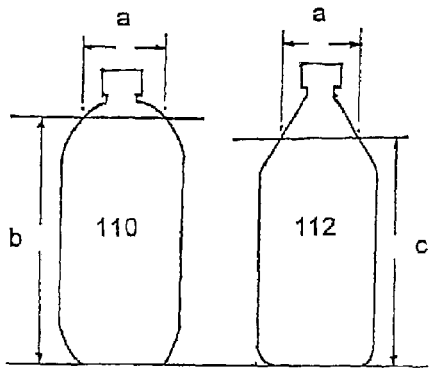
FIG. 15 shows two bottles having different sizes and shapes.

A unique aspect of the present invention is that the present cooling device can be made to accommodate a certain type of beverage bottle, whereas, other beverage bottles having different sizes and shapes are not accommodated. In this respect, FIG. 15 shows two bottles 110, 112 having different shoulder configurations and heights. Bottle 110 has an effective shoulder height of b, based on a dimension a, which represents the effective diameter of the sealing member, such as 23, 76, 242, (or opening 166), etc. Bottle 112, however, has a shorter effective shoulder height of c, based on the same dimension a, of the sealing member. Accordingly, using the same cap and container, with fixed supports on the bottom, such as supports 4, 6, 57, 59, 105, and 220, the cooler can be made so that it will only accommodate one bottle 110 or 112, but not both. Of course, this may not be the case when removable supports 107 or adjustable springs 102 are used.

Figure 16A:
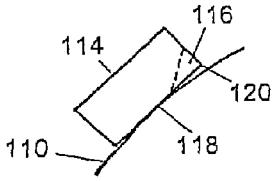
FIGS. 16*a* and 16*b* show cross-sections of an alternative sealing member.
Figure 17:
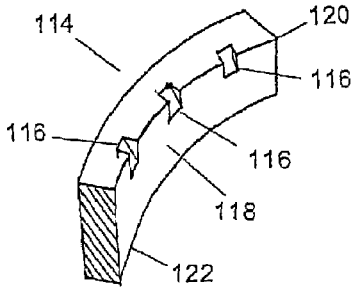
FIG. 17 shows a schematic of the sealing member of FIGS. 16*a* and 16*b;*
Figure 16B:
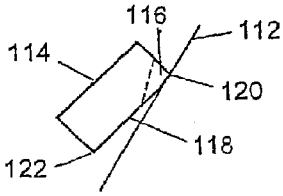

FIGS. 16*a*, 16*b*, 17 show an alternate sealing member 114 with openings 116 on one or more edges 120, 122 that effectively prevent bottles having different shoulder angles from being sealed properly in the same cooling device. With this embodiment, even if the effective shoulder height of each bottle is the same, if the shoulder angle is different enough, the bottle will not seal properly. For example, FIG. 16*a* shows sealing member 114 sealed against bottle 110, wherein the shoulder angle of bottle 110 is adapted to engage flat surface 118. It can be seen that by pressing flat surface 118 against the shoulder of bottle 110, a proper seal can be provided. FIG. 16*b*, on the other hand, shows how the same sealing member 114 cannot be sealed against the shoulder of bottle 112, wherein the shoulder angle is steeper and can cause edge 120 of member 114, not flat surface 118, to engage bottle 112. With bottle 112 held in this manner, it can be seen that openings 116 will remain open and allow water to leak out despite sealing member 114 being pressed against bottle 112. Sealing member 114 is preferably made of a relatively stiff resilient material, and openings 116 can be provided on one edge 120, as shown in FIG. 17, or the other edge 122 (not shown), or both edges 120, 122 (not shown), so that the cooling device will not function properly with bottles having steeper or shallower shoulder angles, as the case may be.

Figure 25A:
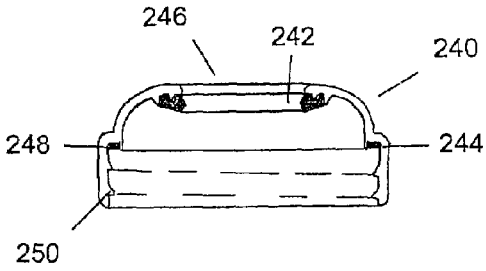
FIGS. 25*a* and 25*b* show another cap and sealing gasket designed for a bottle having a predetermined size and shape.
Figure 25B:
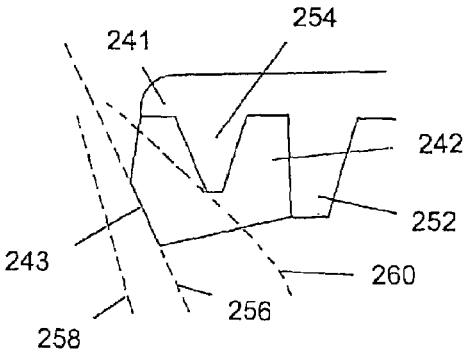

Other means of preventing bottles having different shapes and/or sizes from being used are contemplated. For example, FIGS. 25*a* and 25*b* show sealing member 242 positioned on cap 240, wherein at least two projections 252 and 254 are provided. Outer projection 252 is preferably adapted to extend around the perimeter of sealing member 242 to enable sealing member to be properly secured inside cap 240. In one embodiment, the outside diameter of sealing member 242 can be made slightly larger than the inside diameter of projection 252 so that sealing member 242 can be held by friction alone, i.e., with an interference fit. Projection 252 also serves to maintain or buttress sealing member 242 against the pressure applied when cap 240 is tightened and sealing member 242 presses against a bottle. Projection 254, on the other hand, serves to provide support for sealing member 242, and can provide a pinching effect thereto when pressed against the shoulder of a bottle, to help provide an effective water-tight seal.

At the same time, it can be seen that projections 254 and 252 can severely limit the type of bottle upon which cap 240 can be sealed. In this example, sealing member 242 has been designed to be sealed onto a shoulder of a bottle as shown by the dashed line 256. An engaging surface 243 is designed to make direct contact with the bottle shown by line 256. It can be seen, however, that a bottle having an effective shoulder represented by the dashed line 260 would not allow cap 240 and sealing member 242 to be fitted over the bottle, since the interference would be too great. That is, projections 252 and 254 would interfere with the proper tightening of cap 240 no matter how resilient sealing member 242 was, and therefore, cap 240 could not be used with the bottle represented by line 260. In addition, it can be seen that a bottle having an effective shoulder represented by the dashed line 258 would not allow sealing member 242 to make any contact with the bottle, wherein the cap 240 to would be prevented from being properly sealed against the bottle. Of course, this assumes that the bottle is held in a predetermined substantially fixed location within the container, as discussed previously.

Figure 24A:
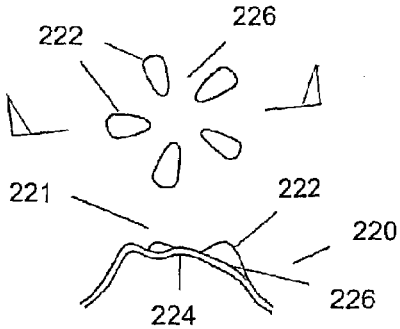
FIGS. 24*a* and 24*b* show different versions of the support for a typical PET bottle.
Figure 24B:
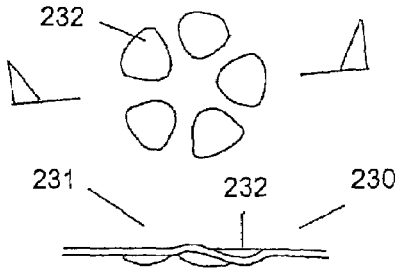

Another means of preventing bottles having different shapes and/or sizes from being used relates to how the bottle is supported, i.e., by the supports, such as central support 93 shown in FIGS. 11 and 12, support 220 shown in FIG. 24*a*, and support 230 shown in FIG. 24*b*. In this respect, it can be seen that the supporting surface, such as surface 95 in FIG. 13*a*, surface 221 in FIG. 24*a*, and surface 231 shown in FIG. 24*b*, are adapted to a particular bottle configuration, i.e., the lower grooves and/or indentation configuration for a particular PET bottle. The supporting surface, in such case, can be made specifically for a particular bottle, and whenever any other bottle having a different lower end configuration is used, the bottle would not fit properly. For example, when the supporting surface, such as surface 221, is designed for a bottle having five grooves, a bottle having four grooves or three grooves would not fit properly, nor could it be seated properly on the supporting surface. This would be the case even if the rest of the bottle is substantially identical to the intended bottle. And in such case, because the size and shape of, and distance between, the sealing member and supports are predetermined for a particular bottle, bottles having a different lower end configuration would not work properly in the cooler. This can be done, for example, where the bottom surface of the intended bottle has a unique configuration, or by custom making a bottle for a particular cooling device.

Figure 19A:
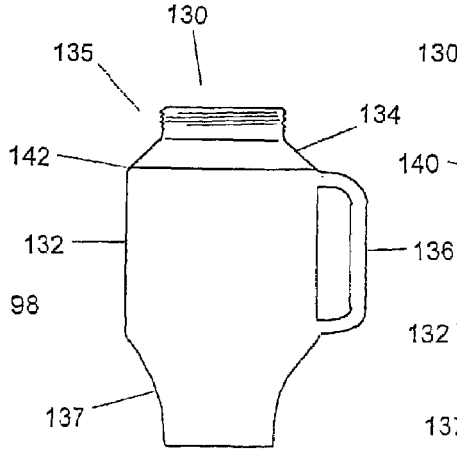
FIGS. 19*a* and 19*b* show a double wall embodiment.
Figure 19B:
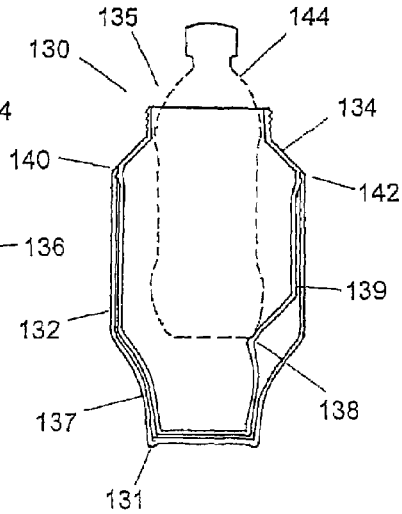

Additional embodiments of the bottle cooler will now be discussed. FIGS. 19*a* and 19*b* show an embodiment of the present invention with double wall construction. In this example, the container 130 is constructed using two pieces, an outer piece 132 and an inner piece 134. Outer piece 132 can have a handle 136, as shown in FIG. 19*a*. In one embodiment, inner piece 134 is preferably blow-molded and has three indentations 138, as shown in FIG. 19*b*, that extend inward to provide a triangular support system for bottle 144, as described above in connection with FIGS. 6–8. In this respect, one or more of the indentations 138 can be adapted to fit into one or more grooves or indentations on bottle 144, as described above, to prevent bottle 144 from rotating inside container 130.

In the embodiment shown, outer piece 132 only extends part way up. This is because the inner piece 134 is blow-molded with upper portion 135 narrowed, and outer piece 132 is injection molded to fit over the widest area of inner piece 134. Of course, where upper portion 135 is not narrowed, such as in FIGS. 23*a* and 23*b*, both pieces could extend all the way up. The lower section 137 is preferably narrowed for fitting into cup-holders, as discussed.

A connecting means 140 is preferably provided at the joint where the upper portion 142 of outer piece 132 connects to inner piece 134. This can be done with sonic welding, a snap-in fit, tongue and groove connection, threads, adhesive, or any other means. A slight gap 139 is preferably provided between inner and outer pieces, 132, 134, for providing insulation properties. Spacers 131 can be provided between inner and outer pieces 132, 134 to support outer piece 132 in relation to inner piece 134.

Figure 23A:
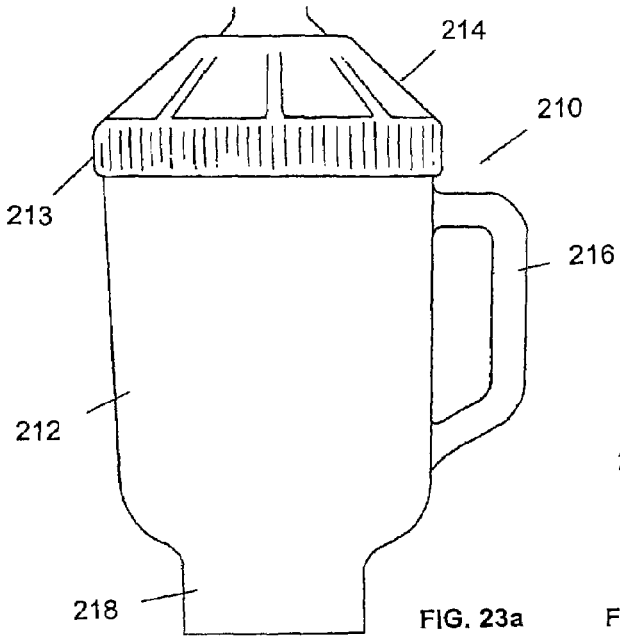
FIGS. 23*a* and 23*b* show another embodiment.
Figure 23B:
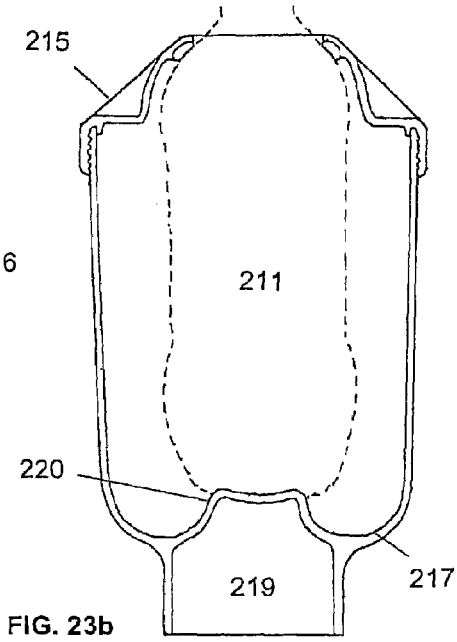

The above represents an example of how the present invention can be made with double wall construction, although any double wall construction is contemplated. For example, the embodiment shown in FIGS. 23*a* and 23*b* can be made with double wall construction, wherein the outer piece can be substantially as shown in FIG. 23*a*, and the inner piece can be substantially as shown in FIG. 23*b*. In such case, both pieces can be injection molded, i.e., made without a narrow neck. A central support, as discussed above, or as shown in FIG. 23*b*, or any other supporting surface, can be used in such case.

Figure 20A:
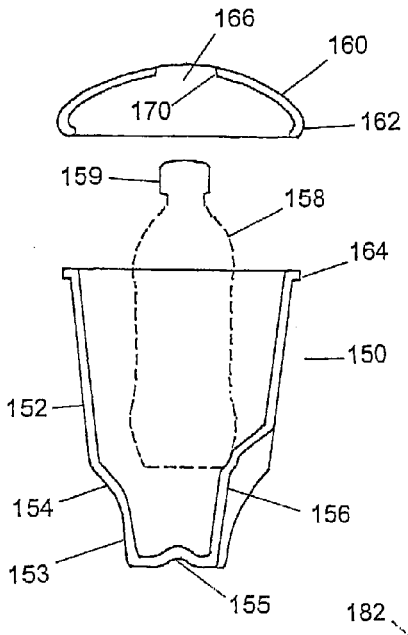
FIGS. 20*a*, 20*b* and 20*c* show a stackable embodiment with a replacement straw.
Figure 20C:
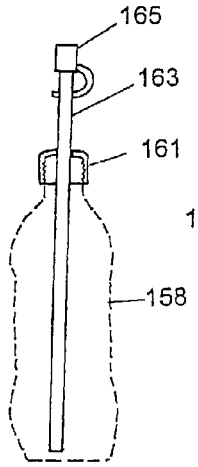
Figure 20B:
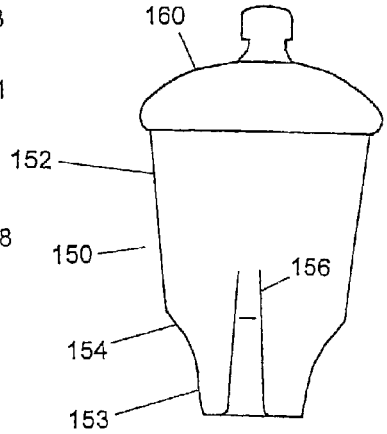

FIGS. 20*a*, 20*b* and 20*c* show an embodiment where containers 150 are made of moldable plastic and capable of being stacked together. FIG. 20*a* shows wall 152 of container 150, including sloped surface 154, lower wall 153, and indentations 156, being slightly angled such that a plurality of like containers 150 can be stacked on top of each other. Lower wall 153 is preferably narrowed to enable container 150 to fit into conventional cup-holders, as discussed previously. The design is preferably made so that it can be injection molded, similar to a stackable plastic cup. This enables container 150 to be economically manufactured, which is advantageous from the standpoint of being sold as a souvenir promotional item, and enables more pieces to be stacked and stored in a smaller space.

In this embodiment, indentations 156 preferably form the supports, as described above, which help to keep bottle 158 in a relatively fixed position. Preferably, there are at least three indentations 156, similar to the supports shown in the embodiment of FIGS. 6–8, except they can be adapted for injection molding, i.e., they can all be like indentation 156 since the molds are separated from top to bottom rather than in halves. The indentations 156 can be adapted to fit into the grooves or indentations on the bottom of the bottle 158, as described above, to prevent bottle 158 from rotating inside container 150. On the other hand, when bottles are used that have pull open tops, i.e., that don't have twist off lids, such as used for non-carbonated beverages, this embodiment can, like the others, be made without supports extending into one or more grooves or indentations on bottle 158. In such case, providing only lateral and vertical support to bottle 158, without preventing bottle 158 from rotating, would be sufficient.

In a variation of this embodiment, a central support, like the support 220 shown in FIG. 24*a*, that can be indented up from the floor 155 of container 150, can be provided. In such case, the floor would be angled or tapered upward so that similar containers 150 could be stacked on top of each other, with one support of one container 150 stacked on top of the support of an adjacent container 150. As discussed above, the upper surface of the support can be adapted to fit into the grooves and/or indentation on the bottom of bottle 158 if desired to prevent rotation of the bottle. In another variation, floor 155 could be provided with a small mesa-like shelf, like that shown in FIG. 21*a*, which can fit into the indentation or groove on bottle 158 to provide support thereto, or indentations 232, like those shown in FIG. 24*b*, can be provided.

Cap 160 is preferably made of molded plastic, and adapted so that it simply snaps onto the top of container 150. A curled over rim 162 is preferably provided that snaps over and onto flange 164 on the upper edge of container 150. This way, container 150 and cap 160 can be easily snapped together. Cap 160 can also be economically manufactured, i.e., it doesn't have to have threads and an interference fit as in the other embodiments, although it can.

In such case, cap 160 preferably has a central opening 166 through which the neck of bottle 158 can extend. Opening 166 does not necessarily have to have a separate resilient sealing member, as in past embodiments, since the plastic material will have some degree of elasticity and resilience. Opening 166 can be formed like a cut-out hole with a predetermined diameter that fits relatively snug over a smooth shoulder of bottle 158. In such case, the inner edge 170 of opening 166 is preferably angled to match the slope of the shoulder, such that a relatively tight fit can be provided. Alternatively, a soft resilient material could be coated or otherwise secured to inner edge 170 to provide an improved seal. Bottle 158 could also be adapted with a horizontal rib around the shoulder where edge 170 meets bottle 158.

While there is the possibility that water could leak in this embodiment, this version is intended to be used with a straw, so that the cooler does not have to be tilted to drink the beverage. That is, this embodiment can be provided with a separate replacement twist-off lid 161 with a built-in straw 163, as shown in FIG. 20*c*, such that after the bottle's lid 159 is opened, the user can simply replace the bottle's lid 159 with the replacement lid 161 and then use straw 163 to drink the beverage. The straw, in such case, preferably has a pull-off cap 165 so that it can be sealed, such as used in sports bottles. An advantage of using a straw is that it can draw beverage from the bottom of bottle 158, which is likely to be where the beverage is the coldest.

Figure 21A:
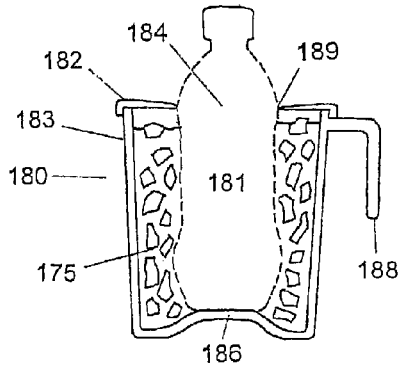
FIGS. 21*a* and 21*b* show a mug/jug embodiment with ice holding ring.
Figure 21B:
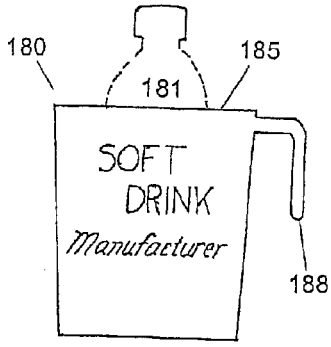

FIGS. 21*a* and 21*b* show a mug/jug version 180 designed to allow a bottle 181 to be placed in and out of the ice, although it can also have a cap like cap 160 or a threaded cap like those discussed previously. The mug 180 can be made like any conventional mug with a support 186 on the bottom to support the bottle, as shown in FIG. 21*a*. The diameter of the wall 183 is preferably large enough to enable ice particles to be stored within the space 175 between bottle 181 and wall 183. The mug 180 is preferably only high enough so that a portion of bottle 181 extends above the upper edge 185. A handle 188 that extends substantially from upper edge 185 can be provided, so that mug 180 can be stacked on top of similar mugs, although a conventional handle can also be provided.

In this embodiment, a cover ring or cap 182, with a central opening 184, is preferably provided to keep the ice and water from leaking out in the event mug 180 is tipped over. The opening 184, in such case, can be adapted to be substantially sealed around or at least be in direct contact with the outer periphery of bottle 180 near the shoulder. The internal edge 189 of ring 182 is preferably narrowed or tapered to form a blade-like edge that can be pressed and sealed against bottle 181. This way, with cover ring 182 positioned on mug 180, bottle 181 can easily be inserted into mug 180, i.e., by pushing it down through opening 184, and removed out of the ice, i.e., by pulling it out through opening 184. Cover ring 182 is preferably designed to snap onto upper edge 185 on top of mug 180 and can be made of a resilient but relatively stiff material. This enables the pieces to be economically made. Because bottle 181 is not held in compression inside mug 180, when users want to drink out of bottle 181, they can use a straw, or remove bottle 181 from mug 180.

Like all other embodiments, this embodiment is intended for use as a promotional or souvenir item with a beverage manufacturer's name and logo printed on mug 180. Other sponsors, such as beverage sellers, can also put their names and logos on mug 180. The present invention contemplates that these mugs 180 can be used to promote the products and services of the manufacturer's and/or sellers whose names and logos are printed on them. It could also be used without cover ring 182, i.e., to double as a large mug and cooler, or with a threaded cap to seal onto the container.

Figure 22A:
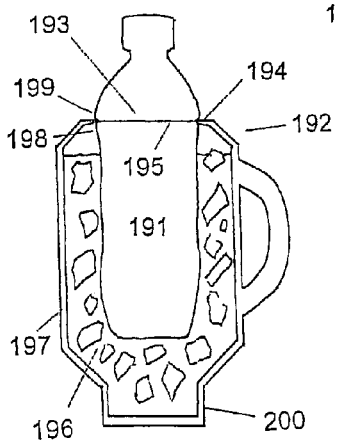
FIGS. 22*a* and 22*b* show a one-piece embodiment.

In FIG. 22*a*, an economical container 190 for holding ice and water around a bottle 191 is shown. Container 190 is preferably sized and shaped to enable a bottle 191 of a predetermined size and shape to be inserted partially therein. As shown in FIG. 22*a*, the wall 197 is preferably adapted such that with bottle 191 positioned in container 190, a space 196 is formed between container 190 and bottle 191 for storing ice particles and/or water therein, as in past embodiments. In this embodiment, however, the upper portion 192 of container 190 is preferably narrowed and provided with an opening 193 having an internal edge 194 having a predetermined size and shape, wherein internal edge 194 is adapted to be substantially pressed against an outer perimeter surface of bottle 191, i.e., just below the shoulder.

In this respect, FIG. 22*a* shows an embodiment where bottle 191 is specially made to have a horizontal rib 195 of a predetermined size and shape at a predetermined location on bottle 191. Rib 195 is preferably adapted such that internal edge 194 of container 190 can be inserted into rib 195, i.e., snapped in, to form a relatively tight fit, wherein the fit can not only provide a substantially water-tight seal between container 190 and bottle 191, i.e., to seal space 196, but also helps to maintain bottle 191 in a predetermined position relative to container 190. And, even if the seal is not water tight, this embodiment can be used with a straw, or allow the bottle to be easily removed from the ice, as discussed above, if desired.

Rib 195 on bottle 191 is preferably shaped with a central portion having a diameter that enables internal edge 194 of container 190 to fit tightly against it. A lower portion 198 of rib 195 is preferably curved and formed having a diameter only slightly greater than that of edge 194, to enable bottle 191 to slide down, while forming a snap point where edge 194 can be fitted into rib 195. An upper portion 199 of rib 195 preferably has a diameter greater than lower portion 198, so that upper portion 199 can prevent bottle 191 from sliding all the way down into container 190. In this respect, it should be seen that upper portion 199 preferably has a diameter greater than any other portion of bottle 191 below it, such that bottle 191 can be inserted into container 190, while at the same time, bottle 191 can be securely held in a predetermined position inside container 190.

In this embodiment, no bottom supports for bottle 191 are needed since the engagement of internal edge 194 with horizontal rib 195 preferably holds bottle 191 in a substantially fixed position in container 190. This may allow, for instance, the beverage to be poured or consumed directly from bottle 191, without having to remove it from the ice, and without the water in the container leaking out. Also, enough of bottle 191 extends above edge 194 so that it can be held by one's hands to prevent rotation of the lid thereof. Double or triple ribs 195 and corresponding double or triple edges 194 can be provided if needed. Container 190 can have a narrowed lower portion 200 for fitting into cup-holders, as discussed before. The embodiment of FIGS. 21*a* and 21*b* can also be adapted to work with a bottle having a similar horizontal rib.

Upper portion 192 can also be provided with one or more sealing members, blade rings or contact surfaces, etc., similar to those disclosed in Applicant's U.S. Provisional Application Ser. No. 60/246,493, filed Nov. 6, 2000, and U.S. application Ser. No. 09/983,107, filed Oct. 23, 2001, which are incorporated herein by reference in their entirety (ribbed and threaded versions are also described). In such case, the sealing surfaces on the container are preferably adapted to engage a corresponding surface on the inner container, which, in this case, is a commercial beverage bottle. Where sealing members, such as blade rings, are used, the beverage bottle preferably has a relatively smooth exterior surface, or one or more horizontal ribs, wherein the engagement of the rings against the exterior surface of the bottle can enable space 196 to be substantially sealed thereby. This version can enable the bottle to be inserted and removed from the container, similar to the embodiments of FIGS. 21*a* and 21*b*.

Figure 22B:
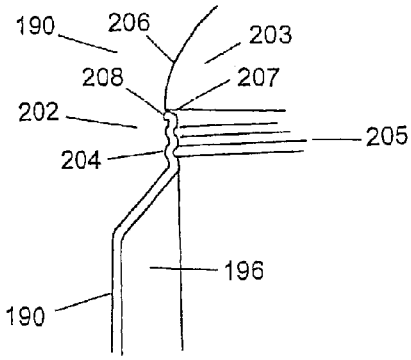

FIG. 22*b* shows an alternative securing means for container 190 with threads 205 formed on the perimeter of bottle 203, i.e., just below the shoulder 206, that engage threads 204 on an upper portion 202 of container 190. In this embodiment, instead of an internal edge 194, container 190 has internal threads 204 extended around the upper portion thereof, adapted to be connected to threads 205, which are extended just below shoulder 206, on bottle 203. In this respect, an upper edge 208 of container 190 is preferably adapted to be pressed and sealed against an abutment portion 207 on bottle 203, such that space 196 between bottle 203 and container 190 can be substantially sealed thereby. Upper edge 208 is preferably adapted with a slightly upwardly and outwardly extended flange that can be resiliently pressed against abutment portion 207, such that the tightening of bottle 203 into container 190 can progressively tighten the seal. Abutment portion 207 preferably has a diameter that is larger than the rest of bottle 203 below it, such that bottle 203 can be rotated into container 190 through opening 193, and be supported by the engagement of upper edge 208 and abutment portion 207. Bottle 203 can, in this respect, be held relatively securely in container 190, as discussed above, with no need for supports.

The embodiment 210 shown in FIGS. 23*a* and 23*b* is similar to the one shown in FIGS. 10–13. This embodiment comprises a container 212, threaded cap 214, handle 216, and lower section 218, etc. In this embodiment, however, the lower support 220 is pushed up from floor 217 in a curved manner, wherein floor 217 is otherwise formed in a bowl-like shape. The support 220, in such case, can be similar to the one shown in FIG. 24*a*. That is, support 220 extends upward and preferably has five ridges 222 equally spaced apart around the circumference thereof, wherein the five ridges can fit into the five grooves found on the lower surface of a conventional PET bottle 211. This way, when bottle 211 is inserted into container 212 and held in substantial compression inside container 212 between cap 214 and support 220, bottle 211 can be prevented from rotating. It can be seen that support 220 can have an upper configuration that is adapted to virtually any type of PET bottle, regardless of its shape, by mirroring the shape of the bottom end of the intended PET bottle, i.e., such as by digital scanning.

The upper surface of support 220 preferably has five valleys 226 into which the five reciprocal extensions on the lower surface of bottle 211 can be positioned. There is also preferably a central mound 224 that can be fitted into a reciprocal indentation on the lower end of bottle 211. This way, the ridges 222, valleys 226 and mound 224 are preferably designed so that they easily prevent ice particles from being trapped on top of support 220, as bottle 211 is being shoved down into the ice, thereby allowing the bottle to be inserted all the way down and properly seated without interference from the ice.

In this respect, the bowl-shaped floor 217 is designed to allow the ice particles, which can be added to container 212 before bottle 211, to be easily displaced when bottle 211 is shoved down into the ice. That is, the ice can be added to the container 212 first, and then the bottle 211 can be shoved down into the ice, wherein inserting the bottle will cause the ice at the bottom of the container 212 to be displaced upward due to the bowl-like curvature of floor 217.

In the embodiment shown, lower section 218 is preferably hollowed out underneath 219 and extended down to provide support for container 212. This enables lower section 218 to be narrowed to fit cup-holders if desired. On the other hand, lower section 218 may be eliminated since container 212 can simply be supported by floor 217 if desired. Alternatively, floor 217 can be made relatively flat 230, as shown in FIG. 24*b*, rather than pushed up. In such case, flat floor 230 preferably has a plurality of indentations 232 in which the reciprocal extensions on the lower end of bottle 211 can be positioned. This enables the bottle to be positioned properly, and helps prevent bottle 211 from rotating when placed into compression. With flat floor 230, it will be desirable to have lower section 218 extended down to provide a level surface on which to support container 212.

Container 212 is preferably injection molded with a slight upward and outwardly angled pitch, as shown in FIG. 23*a*. This further assists in causing the ice to be displaced upward when bottle 211 is shoved down into the ice. This embodiment preferably has a widened neck to enable ice to be added after the bottle is positioned on support 220, wherein it may be desirable to position bottle 211 on top of support 220 before adding the ice. This way, the user can see inside container 212 and position bottle 211 on top of support 220, and can then add ice until container 212 is completely full. Cap 214 is required to be wider due to the wider neck of container 212. In such case, the cap 214 can be designed with web-like members 215 to provide strength and rigidity if desired. Grips 213 can also be provided to make it easier to tighten and remove. The container 212 of this embodiment, without lower section 218, can be injection blow-molded with a relatively narrow neck, by using a third lower mold piece to form the shape of support 220 if desired.

A preferred cap design for the embodiment of FIGS. 6-8 is shown in FIGS. 25*a* and 25*b*. As discussed previously, this cap 240 has sealing member 242 extended around central opening 246, and a sealing gasket 244 within groove 248. Sealing member 242 is designed to be pressed with engaging surface 243 directly against the shoulder of a bottle, as represented by dashed line 256 in FIG. 25*b*. Projection 252 is designed to brace sealing member 242 on the outside diameter, and to hold sealing member 242 in place, such as with an interference fit, as discussed previously. Projection 254 is designed to help support sealing member 242, and provide a pinching effect when sealing member 242 is pressed against the bottle. Projection 254 also helps to effectively prevent bottles having higher and/or wider shoulder areas, such as represented by dashed line 260, from being properly held inside the bottle cooler. Line 258 shows how a bottle having a lower and/or narrower shoulder area would allow water to leak, since engaging surface 243 would not be able to make contact with and be sealed against the bottle.

It can also be seen that different caps similar to cap 240 can be made to accommodate bottles of different sizes and shapes, even if the same container is used. That is, various PET bottles of the same volume size have similar grooves and indentations on the bottom end, but otherwise have different upper bottle configurations, such as Coke® and Pepsi® 20 ounce bottles. Accordingly, the present invention contemplates that separate caps can be made to accommodate the different bottles so that a single container can be used for both types of bottles. For example, one cap can be provided to fit a Coke® 20 ounce bottle, and another cap can be provided to fit a Pepsi® 20 ounce bottle. This way, a single container can be sold with multiple caps to enable more than one type of bottle to fit properly.

Different size and shape sealing members 242 and sealing gaskets 244 can also be used to accommodate slightly different bottles if desired (so long as the projections 252, 254 will allow them to be used). In such case, the sealing members 242 and sealing gaskets 244 can be made so that they can be hand inserted and secured with an interference fit, wherein sealing members 242 and sealing gaskets 244 can easily be replaced when desired.

Each main piece, including caps 3, 75, 160, 214, and 240, and containers 5, 55, 77, 130, 150, 180, 190, and 212, is preferably made from a moldable plastic, such as polyethylene, HDPE, polypropylene, PET, PVC, polystyrene, polycarbonate, etc., although any conventional material, such as stainless steel, glass, ceramic, etc., can also be used. While for insulation purposes containers 5, 55, 77, 150, 180, 190 and 212 can be made of materials that conduct heat poorly, or with double wall construction, as shown in FIGS. 19*a* and 19*b*, they can also simply be made of a relatively thick or rigid plastic. In this respect, the thickness preferably provides rigidity and a sufficient level of insulating properties thereto, although any thickness that provides the necessary support can be used. Caps 3, 75, 160, 214 and 240, and containers 77, 150, 180 and 212, and outer piece 132 of container 130, can be injection molded, although containers 55 and 190, and inner piece 134, are preferably blow-molded. Blow-molding not only allows the supports, such as 57, 59 and 138, to be indented, but openings 71 and upper portions 135 and 192 to be narrow relative to the portions below it. Container 5 can be made by any suitable method.

Other steps preferably involved in making caps 3, 75, 160, 182, 214 and 240 and containers 5, 55, 77, 130, 150, 180, 190, and 212 include measuring and/or scanning the bottle to obtain precise shapes and dimensions. Three-dimensional digital scanning can be done on equipment designed for this purpose. This enables the cap and container, and any engaging portion, such as sealing members, edges and surfaces, to be adapted precisely to a particular bottle, so that the bottle can be held in the container substantially leak-free.

The present invention also contemplates that bottles can be custom made to fit the container, i.e., with surfaces that engage the sealing member and supports, if desired, as shown in FIGS. 22*a* and 22*b*. That is, the bottles can be made with a predetermined size and shape, and the containers can be designed so that the bottle will fit properly in the containers. Textures, grips and/or indentations can also be provided on the container or cap for improved grip. The containers can have a handle, although a strap, or indented grips 98, as shown in FIG. 18, can also be used. One or both pieces can be made of transparent or translucent material so that the contents can be seen from outside. When double walls are used both can be clear, or one can be clear and the other opaque or translucent. Indicator lines can be provided on each embodiment, and in particular, those where the upper portion is narrowed.

For the above reasons, the present invention contemplates using a method wherein one beverage company, including manufacturers, bottlers, suppliers, etc., can use the bottle cooler to increase sales and market share of its bottled beverage products at the expense of its competitors. Because certain embodiments of the present bottle cooler discussed above can be made so that only one or a select type of bottle can fit properly, by promoting that bottle cooler, i.e., getting people to try it and like it, a beverage company can use the bottle cooler as a marketing tool to increase sales of its own bottled beverage products. That is, consumers will have to buy bottled beverage products produced by that company if they want to use the bottle cooler to keep their beverages cold, because only those bottles will work properly with the bottle cooler. Buying any other bottled product made by any other company would make it so that the bottle cooler cannot be used.

This can be done, for example, as discussed above, by adapting the cooler so that the distance between the cap's sealing member and the bottom supports, when the cap is tightened onto the container, will only allow one type of bottle to fit properly. Other adaptations, such as using sealing members that only provide a seal on bottles having a particular size and shape, as well as support members that only fit into grooves and/or indentations on certain bottles, can also be used. In fact, it is contemplated that virtually any type of bottle cooler for individual bottles, that allows a particular bottled beverage product to be positioned in the bottle cooler, including those discussed above, and those that use refrigerants that have to be refrozen, can be used as a means of promoting the bottled beverage products.

The above discussion illustrates some of the preferred embodiments and features of the present invention. It should be understood, nevertheless, that other embodiments and features, such as those not specifically disclosed herein, which may perform in the intended manner, are also within the scope of the present invention.

For purposes of claiming future priority, U.S. patent application Ser. No. 09/983,107, filed on Oct. 23, 2001, and U.S. Provisional Patent Application Ser. No. 60/246,493, filed on Nov. 6, 2000, are incorporated herein by reference.

What is claimed is:

1. A cooling device for holding a beverage receptacle, comprising:

a container adapted to enable the beverage receptacle to be inserted at least partially therein, wherein said container is adapted such that when the beverage receptacle is placed in said cooling device, a space for storing ice particles in direct contact with the beverage receptacle is formed between the beverage receptacle and said container;

a cap adapted to be substantially sealed onto said container, wherein said cap has an opening through which a neck of the beverage receptacle can be extended;

a sealing member on said cap adapted to be pressed and sealed against a shoulder of the beverage receptacle when the beverage receptacle is placed in said cooling device;

at least one support on the inside of said container for engaging the beverage receptacle in a predetermined position, wherein at least one of said at least one support is adapted to engage a portion of the beverage receptacle in a manner that substantially prevents the beverage receptacle from rotating inside said cooling device; and wherein said cooling device is adapted such that when said cap is substantially sealed onto said container, with the beverage receptacle placed in the predetermined position, said sealing member is substantially sealed against the shoulder of the beverage receptacle, and the beverage receptacle is prevented from being lifted in a manner that would allow the beverage receptacle to freely rotate inside said container, and the space is substantially sealed.

2. The cooling device of claim 1, wherein said at least one support comprises a plurality of support members, wherein at least one of said plurality of support members extends inward and/or upward to help maintain the beverage receptacle in the predetermined position, and at least another of said support members comprises a coil spring extending upward from a floor of said container to engage the beverage receptacle.

3. The cooling device of claim 1, wherein said at least one support comprises at least one member adapted to fit into at least one of five grooves located on the beverage receptacle to substantially prevent the beverage receptacle from rotating inside said cooling device.

4. The cooling device of claim 1, wherein a lower portion of said container is adapted with a substantially bowl shaped configuration, such that when the beverage receptacle is inserted into said container, the ice particles below the beverage receptacle are displaced in a manner that allows the beverage receptacle to be inserted into the predetermined position.

5. The cooling device of claim 1, wherein said container is adapted such that with the beverage receptacle in the predetermined position, a gap of sufficient size exists between a lower portion of the beverage receptacle and said container, such that ice particles below the beverage receptacle will not be trapped in a manner that would prevent the beverage receptacle from being inserted into the predetermined position.

6. The cooling device of claim 1, wherein the beverage receptacle is adapted on the bottom with five substantially identical and evenly spaced grooves, and wherein said at least one support comprises at least two support members adapted to fit substantially into at least two of the grooves.

7. The cooling device of claim 1, wherein the beverage receptacle is adapted on the bottom with five substantially identical and evenly spaced grooves, and wherein said at least one support comprises at least one support adapted to fit into at least one of the grooves, and at least another support adapted to help maintain the beverage receptacle in the predetermined position without fitting into any of the grooves.

8. The cooling device of claim 1, wherein said sealing member is comprised of a resilient material and at least one feature taken from the group consisting of:

a) a sealing portion that extends relatively downward and inward to engage and press against the shoulder of the beverage receptacle;

b) a configuration having at least one blade or rib formed thereon;

c) a portion connected to a plurality of projections extending from said cap;

d) a portion that is adapted to be snapped mechanically into said cap;

e) a portion that is adhered, bonded, or fused directly to said cap;

f) a portion that is bonded to said cap using a two shot or overmold method; and g) a thickness and/or resiliency sufficient to provide a seal against beverage receptacles that are not made to exact dimensions.

9. A cooling device for holding a beverage receptacle adapted on the bottom with five substantially identical and evenly spaced grooves, comprising:

a container adapted to enable the beverage receptacle to be placed at least partially inside said container, wherein said container is adapted such that when the beverage receptacle is placed in a predetermined position inside said container, a space for storing ice particles in direct contact with the beverage receptacle is formed between the beverage receptacle and said container;

a cap adapted to be substantially sealed onto said container, wherein said cap has an opening through which a neck of the beverage receptacle can be extended;

a sealing member on said cap adapted to be pressed against the beverage receptacle when the beverage receptacle is placed in the predetermined position;

at least two support members on the inside of said container for supporting the beverage receptacle in the predetermined position, wherein said at least two support members are adapted to fit into at least two of the five grooves located on the beverage receptacle, such that with the beverage receptacle in the predetermined position, the beverage receptacle is substantially prevented from rotating inside said cooling device; and wherein said cooling device is adapted such that when said cap is substantially sealed onto said container, with the beverage receptacle in the predetermined position, said sealing member is substantially sealed against the beverage receptacle, and the space is substantially sealed.

10. The cooling device of claim 9, wherein said cap and said sealing member are adapted such that when said cap is sealed onto said container, and the beverage receptacle is in the predetermined position, the beverage receptacle is prevented from being lifted in a manner that would allow the beverage receptacle to freely rotate inside said cooling device.

11. The cooling device of claim 9, wherein said at least two support members extend higher than another support located on said container, wherein said another support is adapted to support the beverage receptacle without fitting into any of the five grooves.

12. The cooling device of claim 11, wherein said another support is a spring extending from a floor of said container.

13. The cooling device of claim 9, wherein said at least two support members comprise five members adapted to fit into the five grooves, such that with said five members filled into the five grooves, the beverage receptacle is substantially prevented from rotating inside said cooling device.

14. The cooling device of claim 9, wherein said container is adapted such that with the beverage receptacle in the predetermined position, a gap of sufficient size exists between a lower portion of the beverage receptacle and said container, such that ice particles below the beverage receptacle are not trapped in a manner that would prevent the beverage receptacle from being inserted into the predetermined position.

15. The cooling device of claim 9, wherein a lower portion of said container is adapted with a substantially bowl shaped configuration, such that when the beverage receptacle is inserted into said container, the ice particles below the beverage receptacle can be displaced in a manner that allows the beverage receptacle to be inserted into the predetermined position.

16. The cooling device of claim 9, wherein said sealing member is comprised of a resilient material and at least one feature taken from the group consisting of:

a) a sealing portion that extends relatively downward and inward to engage and press against the beverage receptacle's shoulder;

b) a configuration having at least one blade or rib formed thereon;

c) a portion connected to a plurality of projections extending from said cap;

d) a portion that is adapted to be snapped mechanically into said cap;

e) a portion that is adhered, bonded, or fused directly to said cap;

f) a portion that is bonded to said cap using a two shot or overmold method; and g) a thickness and/or resiliency sufficient to provide a seal against beverage receptacles that are not made to exact dimensions.

17. A cooling device for holding a beverage receptacle adapted on the bottom with five substantially identical and evenly spaced grooves, comprising:

a container adapted to enable the beverage receptacle to be placed at least partially inside said container, wherein said container is adapted such that when the beverage receptacle is placed in a predetermined position inside said container, with a central axis of the beverage receptacle extending vertically, a space for storing ice particles in direct contact with the beverage receptacle is formed between the beverage receptacle and said container, a cap adapted to be substantially sealed onto said container, wherein said cap has an opening through which a neck of the beverage receptacle can be extended;

a sealing member on said cap adapted to be pressed against the beverage receptacle when the beverage receptacle is placed in the predetermined position;

a plurality of support members on the inside of said container for maintaining the beverage receptacle in the predetermined position, wherein with the beverage receptacle in the predetermined position, at least one of said plurality of support members is adapted to fit into at least one of the five grooves, and at least another of said plurality of support members is adapted to help maintain the beverage receptacle in the predetermined position without fitting into any of the five grooves; and wherein said cooling device is adapted such that when said cap is substantially sealed onto said container, with the beverage receptacle in the predetermined position, said sealing member is substantially sealed against the beverage receptacle, and the space is substantially sealed.

18. The cooling device of claim 17, wherein, the location at which said at least one of said plurality of support members extends into said at least one of the five grooves is higher than a point at which said at least another of said plurality of support members contacts the beverage receptacle.

19. The cooling device of claim 17, wherein said plurality of support members comprises at least one feature taken from the group consisting of:

a) said at least one of said plurality of support members is formed as an indentation on said container;

b) said at least another of said plurality of support members is formed as an indentation on said container;

c) said at least one of said plurality of support members is adapted with a sloped surface for self-centering the beverage receptacle; and d) said at least another of said plurality of support members is adapted with a sloped surface for self-centering the beverage receptacle.

20. The cooling device of claim 17, wherein said at least another of said plurality of support members comprises a coil spring extending upward from a floor of said container.

* * * * *